US007926667B2

(12) United States Patent
Ding et al.

(10) Patent No.: US 7,926,667 B2
(45) Date of Patent: Apr. 19, 2011

(54) RACK FOR HOLDING WORKPIECES

(75) Inventors: Jiang-Rong Ding, Shenzhen (CN); Ji-Kai Liu, Shenzhen (CN); Jia-Cai Luo, Shenzhen (CN); Cha-Song Xie, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 584 days.

(21) Appl. No.: 11/967,103

(22) Filed: Dec. 29, 2007

(65) Prior Publication Data

US 2009/0101602 A1 Apr. 23, 2009

(30) Foreign Application Priority Data

Oct. 19, 2007 (CN) ..... 2007 1 0202152

(51) Int. Cl.
*A47G 19/08* (2006.01)

(52) U.S. Cl. ..... 211/41.5; 211/169.1; 211/181.1; 211/26.2

(58) Field of Classification Search ..... 211/41.15, 211/181.1, 169, 184, 169.1, 41.4, 41.5, 168, 211/150, 189, 26.1, 26.2; 206/321; 220/491; D6/458, 462, 566; 248/153, 175, 302
See application file for complete search history.

(56) References Cited

U.S. PATENT DOCUMENTS

| | | | | | |
|---|---|---|---|---|---|
| 2,047,097 | A * | 7/1936 | Dunbar | 211/169.1 |
| 2,479,118 | A * | 8/1949 | Jenness | 211/41.5 |
| 2,686,598 | A * | 8/1954 | Brecht | 211/41.5 |
| 2,841,288 | A * | 7/1958 | Field et al. | 211/41.4 |
| 3,556,620 | A * | 1/1971 | Gutierrez | 312/136 |
| RE27,462 | E * | 8/1972 | Gutierrez | 211/40 |
| 3,777,896 | A * | 12/1973 | Ehrlich | 211/59.2 |
| 4,046,261 | A * | 9/1977 | Yake | 211/41.8 |
| 4,426,007 | A * | 1/1984 | Beleckis et al. | 211/40 |
| 5,314,244 | A * | 5/1994 | Swets et al. | 312/330.1 |
| 5,823,100 | A * | 10/1998 | Wienhold et al. | 99/449 |
| 6,116,436 | A * | 9/2000 | Ferrucci et al. | 211/187 |
| 6,386,096 | B1 * | 5/2002 | Tiemann | 99/426 |
| 6,431,377 | B1 * | 8/2002 | Lechman | 211/133.2 |
| 6,688,478 | B2 * | 2/2004 | Miller et al. | 211/59.2 |
| 7,140,705 | B2 * | 11/2006 | Dressendorfer et al. | 312/348.3 |
| 2004/0065629 | A1 * | 4/2004 | Hunt et al. | 211/40 |
| 2004/0099619 | A1 * | 5/2004 | Bustos | 211/59.2 |
| 2004/0256341 | A1 * | 12/2004 | Donnell et al. | 211/187 |
| 2006/0113262 | A1 * | 6/2006 | Knorring et al. | 211/59.2 |

* cited by examiner

*Primary Examiner* — Jennifer E. Novosad
(74) *Attorney, Agent, or Firm* — Jeffrey T. Knapp

(57) ABSTRACT

A rack (100) configured for holding workpieces is provided. The rack includes a base (10) and a plurality of fixtures (20). The base includes two lateral frames (14) and a fixing frame (16) fitted between the two lateral frames. Each of the lateral frames includes a first stopper (147) and a second stopper (148) mounted thereon. The fixing frame has two fixing poles (164) parallel to the two lateral frames. Each of the two fixing poles has a plurality of latching means (166) mounted thereon in line. The plurality of fixtures rotatably engage with the latching means of the fixing frame and are fitted between the first stopper and the second stopper.

11 Claims, 6 Drawing Sheets

RACK FOR HOLDING WORKPIECES

BACKGROUND OF THE INVENTION

1. Field of the Invention

The present invention generally relates to racks, particularly, to a rack used to hold workpieces during ultrasonic washing.

2. Discussion of the Related Art

Ultrasonic washing is widely used for cleaning workpieces. During washing, the workpieces are fixed on racks and the racks are placed into a washing liquid. The washing liquid is then vibrated ultrasonically by an ultrasonic generator and the workpieces are cleaned by the vibration of the washing liquid.

Referring to FIG. 5 and FIG. 6, a typical rack 500 includes a frame 51 and a plurality of retainers 52 fixed on the frame 51. Each retainer 52 includes two opposite flexuous first arms 521 and a flexuous second arm 522 installed below the first arms 521. Each first arm 521 and second arm 522 zigzags, thus forming a plurality of first V-shaped portions 5211 on each first arm 521 and a plurality of second V-shaped portions 5221 on the second arm 522. The apex of the V's, of each first V-shaped portions 5211 and each second V-shaped portions 5221, align with each other. One second V-shaped portion 5221 cooperates with two corresponding first V-shaped portions 5211 to define a fixing space (not labeled). Thus a workpiece 53 can be fixed in the fixing space. In this way, the typical rack 500 can accommodate a plurality of workpieces 53 therein.

However, some workpieces, such as a housing of a mobile phone, generally, includes a polished portion formed on a side of the housing. When the workpiece is being placed on the rack 500, the polished portion comes into contact with the first arms 521 and the second arm 522. Thus, the polished portion may be scratched, by the first arms 521 and/or the second arm 522, when being mounted, removed, or during washing of the workpiece.

Therefore, an improved rack is desired in order to overcome the above-described shortcomings.

SUMMARY

In one embodiment thereof, a rack configured for holding workpieces is provided. The rack includes a base and a plurality of fixtures. The base includes two lateral frames and a fixing frame fitted between the two lateral frames. Each of the lateral frames includes a first stopper and a second stopper mounted thereon. The fixing frame has two fixing poles parallel to the two lateral frames. Each of the two fixing poles has a plurality of latching means mounted in a line thereon. The plurality of fixtures rotatably engage with the latching means of the fixing frame and are fitted between the first stopper and the second stopper.

Other advantages and novel features will become more apparent from the following detailed description of preferred embodiments when taken in conjunction with the accompanying drawings.

BRIEF DESCRIPTION OF THE DRAWINGS

Many aspects of the housing for an electronic device can be better understood with reference to the following drawing. The components in the drawing are not necessarily drawn to scale, the emphasis instead being placed upon clearly illustrating the principles of the housing for an electronic device.

Moreover, in the drawing like reference numerals designate corresponding parts throughout the several views.

DETAILED DESCRIPTION OF THE PREFERRED EMBODIMENTS

Figure 1:
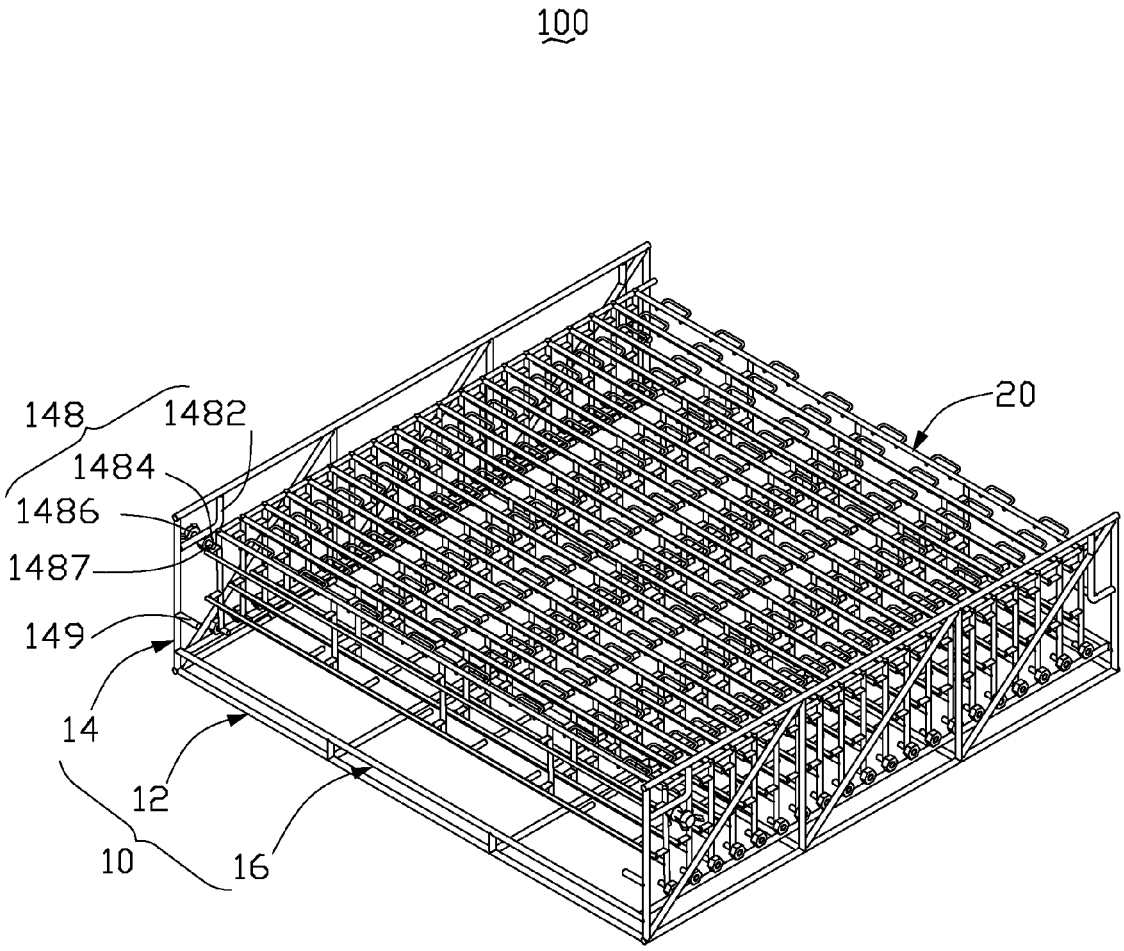
FIG. 1 is a schematic view of a rack, in accordance with a present embodiment.

Referring to the drawings in detail, FIG. 1 shows a rack 100, in accordance with a present embodiment. The rack 100 includes a base 10 and a plurality of fixtures 20 mounted on the base 10.

Figure 2:
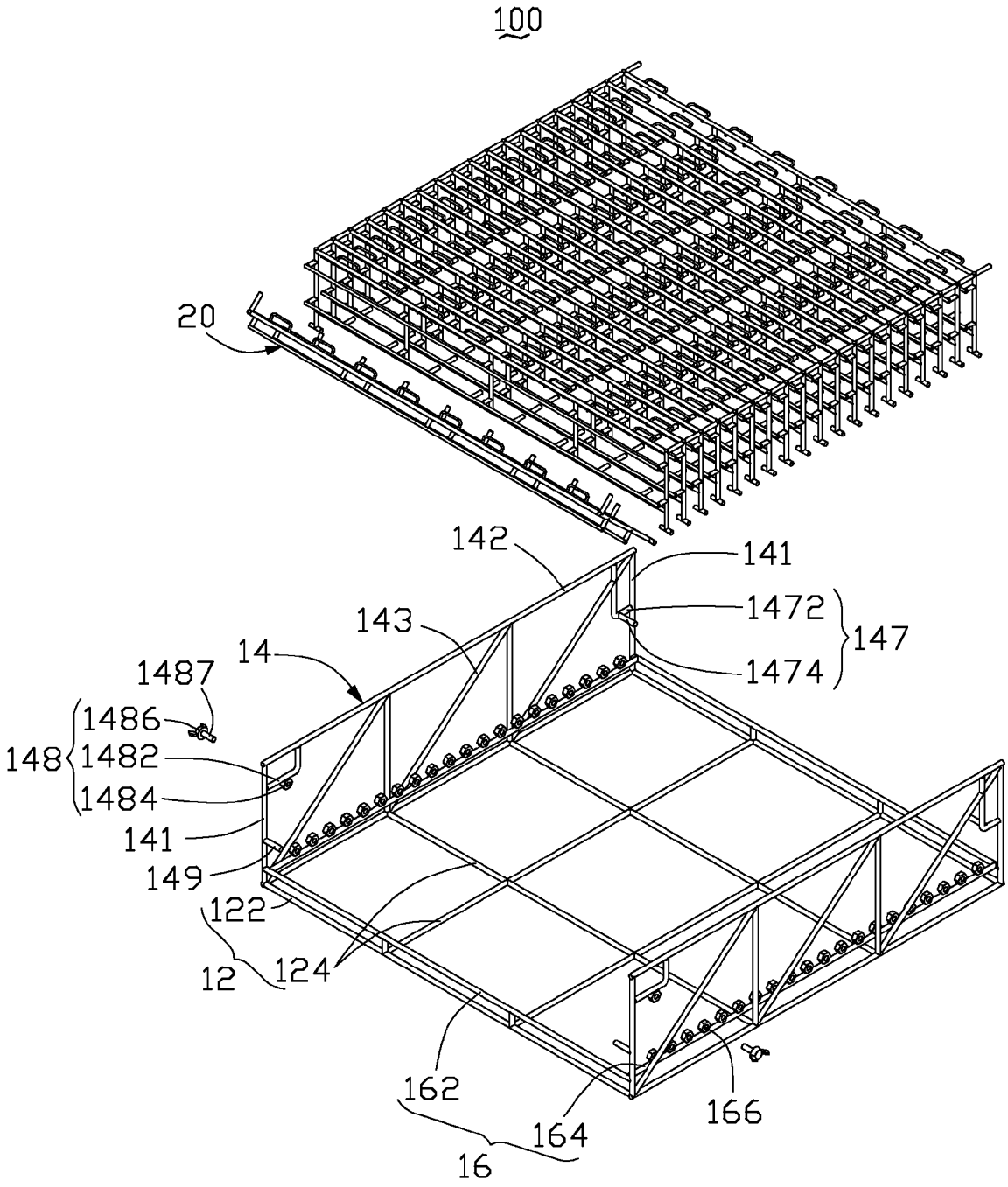
FIG. 2 is a disassembled view of the rack shown in FIG. 1.

Referring to FIG. 2, the base 10 includes a bottom frame 12, two lateral frames 14 respectively mounted at two opposite side of the bottom frame 12, and a fixing frame 16 respectively mounted between the two lateral frames 14.

The bottom frame 12 includes four basal bars 122 and a plurality of crisscrossed first supporting branches 124. The four basal bars 122 are fitted and joined together to define a plane frame. The plurality of crisscrossed first supporting branches 124 are connected to and defined in the plane frame formed by the four basal bars 122.

Each of the two lateral frames 14 includes two parallel standing poles 141, a crossbeam 142 fixing on the two standing poles 141, a plurality of second supporting branches 143, a first stopper 147, a second stopper 148, and a third stopper 149. Each of the two standing poles 141 is perpendicularly fitted to (e.g., welded to) one of the basal bars 122 of the bottom frame 12. The crossbeam 142 is fitted to the two standing poles 141 at an opposite end to the basal bars 122 of the bottom frame 12. The plurality of second supporting branches 143 is joined with the crossbeam 142 and the basal bars 122 of the bottom frame 12, and are configured for supporting the crossbeam 142.

The first stopper 147 includes a first joining branch 1472 and a protruding post 1474 fixed to the first joining branch 1472. The first joining branch 1472 is fitted to, or welded to one of the standing poles 141. One end of the protruding post 1474 is fixed to (e.g., welded to) the first joining branch 1472, with the other end thereof facing to an opposite one of the two lateral frames 14.

The second stopper 148 includes a second joining branch 1482, a first latching nut 1484, and a bolt 1486. The second joining branch 1482 is fitted to, or welded to one of the standing poles 141, especially welded to an opposite one of the two standing poles 141 to that the first stopper 147 is fixed to. The first latching nut 1484 is fixed to the second joining branch 1482. The bolt 1486 is secured in the first latching nut 1484, with one end thereof extending out and facing to an opposite one of the two lateral frames 14.

The third stopper 149 may be a post, with one end thereof being fitted to one of the standing poles 141 and the other end thereof facing to an opposite one of the two lateral frames 14.

The fixing frame 16 includes two parallel bearing poles 162 and two parallel fixing poles 164 respectively joined together with the two parallel bearing poles 162. The two parallel bearing poles 162 are fitted between the two the two lateral frames 14. Each of the two parallel bearing poles 162 has two ends respectively welded to the standing poles 141 of the two lateral frames 14. Each of the two parallel fixing poles 164 has a plurality of second latching nuts 166 welded thereon in line. The parallel fixing poles 164 are welded between the two parallel bearing poles 162, especially arranged in parallel with the bottom frame 12 and the lateral frames 14.

Figure 3:
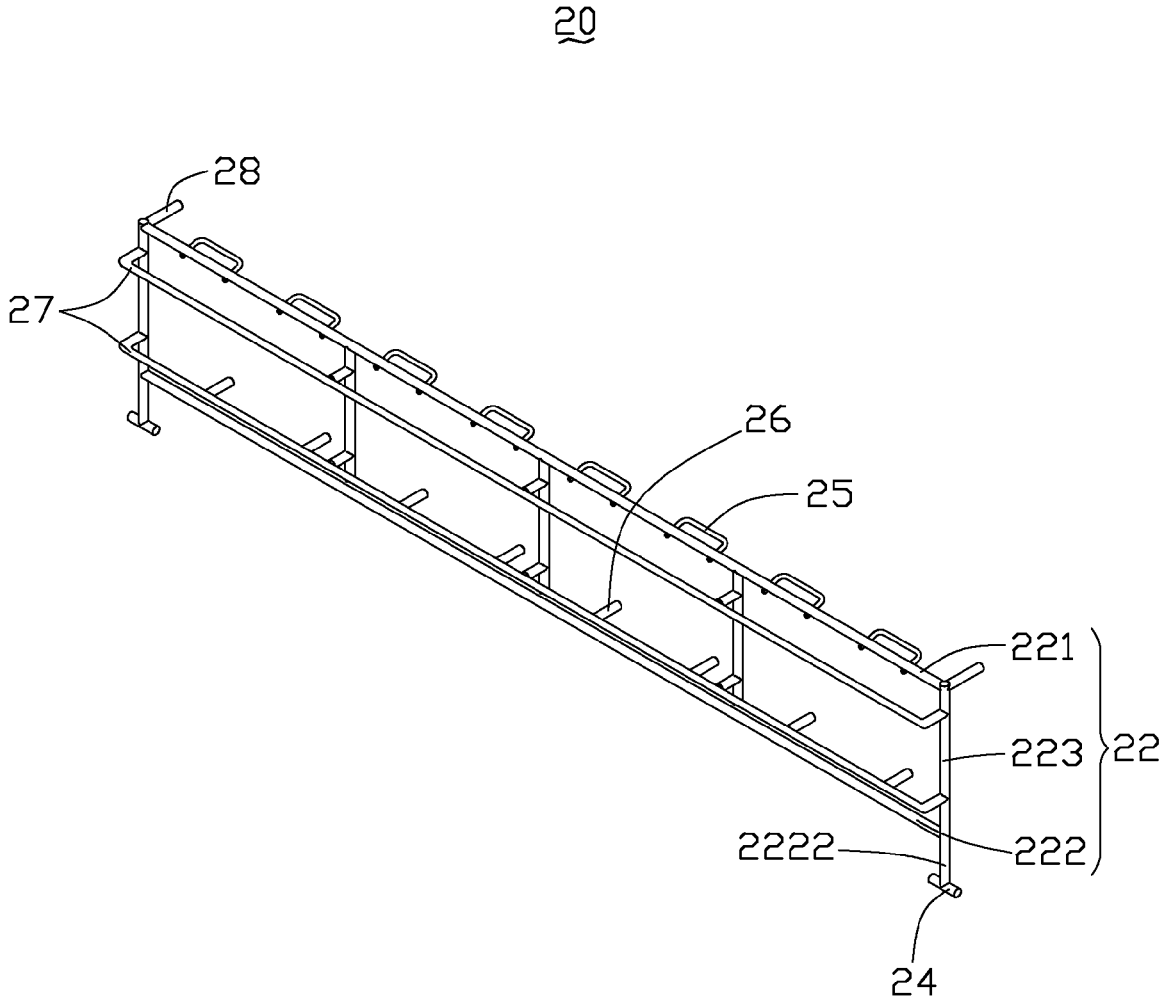
FIG. 3 is a schematic view of a fixture of the rack shown in FIG. 1.

Referring to FIG. 3, each of the fixtures 20 includes a basal frame 22, two latching pins 24, a plurality of hanging hooks 25, a plurality of hanging posts 26 fitted on the basal frame 22, two spacing bars 27, and two spacing posts 28. The basal frame 22 includes a first holding beam 221, a second holding beam 222, and two parallel supporting poles 223. The first holding beam 221 and the second holding beam 222 are welded onto the two supporting poles 223 in such manner that the first holding beam 221, the second holding beam 222, and the two supporting poles 223 are joined together to form a rectangular frame. Each of the two parallel supporting poles 223 has a free end 2222 extending out from the basal frame 22.

The latching pins 24 are respectively welded to the free end 2222 of the supporting poles 223. Each of the hanging hooks 25 has two hooked ends 251 welded to the first holding beam 221. The hanging hooks 25 are configured (i.e., structured or arranged) for holding workpieces. The hanging posts 26 are fitted on the second holding beam 222. Each of the hanging posts 26 is configured for holding workpieces, associating with a corresponding one of the hanging hooks 25. Each of the two spacing bars 27 has two bent ends 271 respectively welded to the two supporting poles 223. The two spacing posts 28 are respectively fitted on the two supporting poles 223 at an opposite side to the two spacing bars 27.

In assembly, the fixtures 20 are rotatably mounted on the fixing frame 16 in a predetermined order, with the latching pins 24 of the fixtures 20 being respectively rotatably inserted into the second latching nuts 166 of the fixing frame 16. The supporting poles 223 of one of the fixture 20 resist the first stoppers 147 of the lateral frames 14. The spacing bars 27 of the fixtures 20 resist the supporting poles 223 of one of the neighboring of the fixtures 20. The spacing posts 28 of the fixtures 20 resist the supporting poles 223 of one of the neighboring of the fixtures 20, except the spacing posts 28 of one of the fixtures 20 resisting the first stoppers 147 of the lateral frames 14. Then, the bolt 1486 is secured into the first latching nut 1484, with one end 1487 thereof extending out and facing to an opposite one of the two lateral frames 14. The supporting poles 223 of one of the fixtures 20 adjacent to the second stopper 148 resist the end 1487 of the bolt 1486 of the second stopper 148. As such, the fixtures 20 are mounted on the base 10 to form the rack 100.

Figure 4:
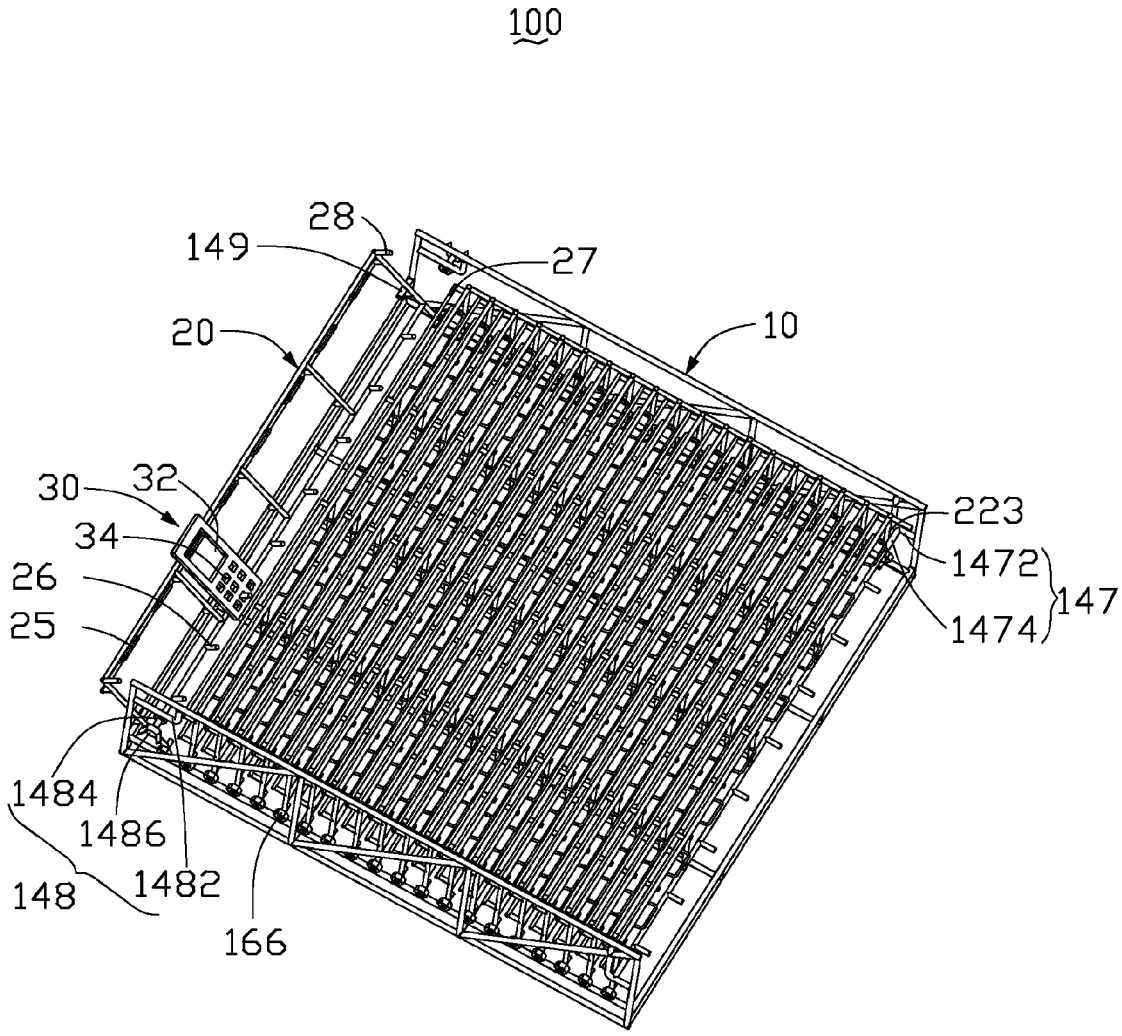
FIG. 4 is a schematic view of the rack shown in FIG. 1 with a workpiece mounted thereon.
Figure 5:
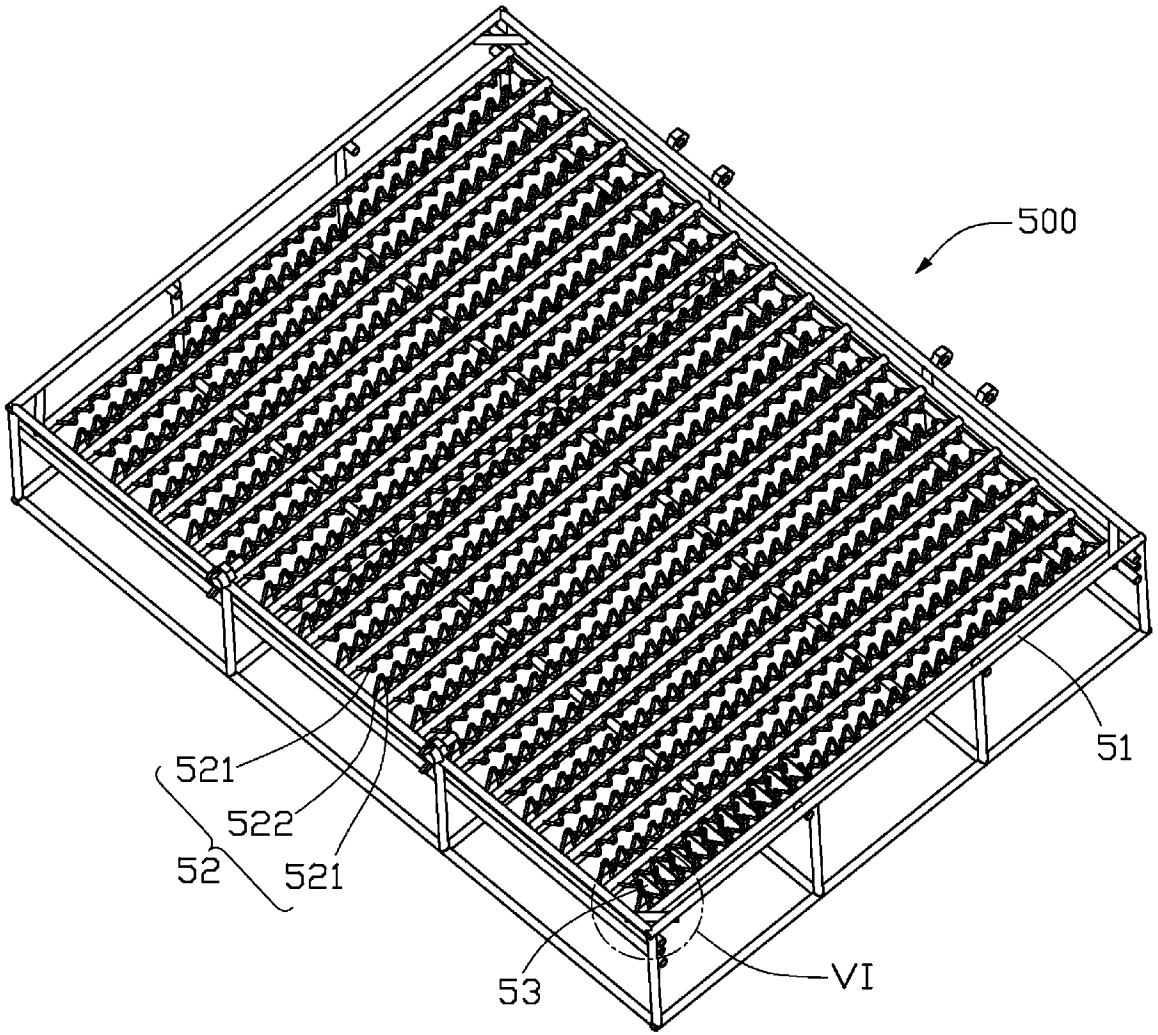
FIG. 5 (RELATED ART)
FIG. 5 is a schematic view of a typical rack.
Figure 6:
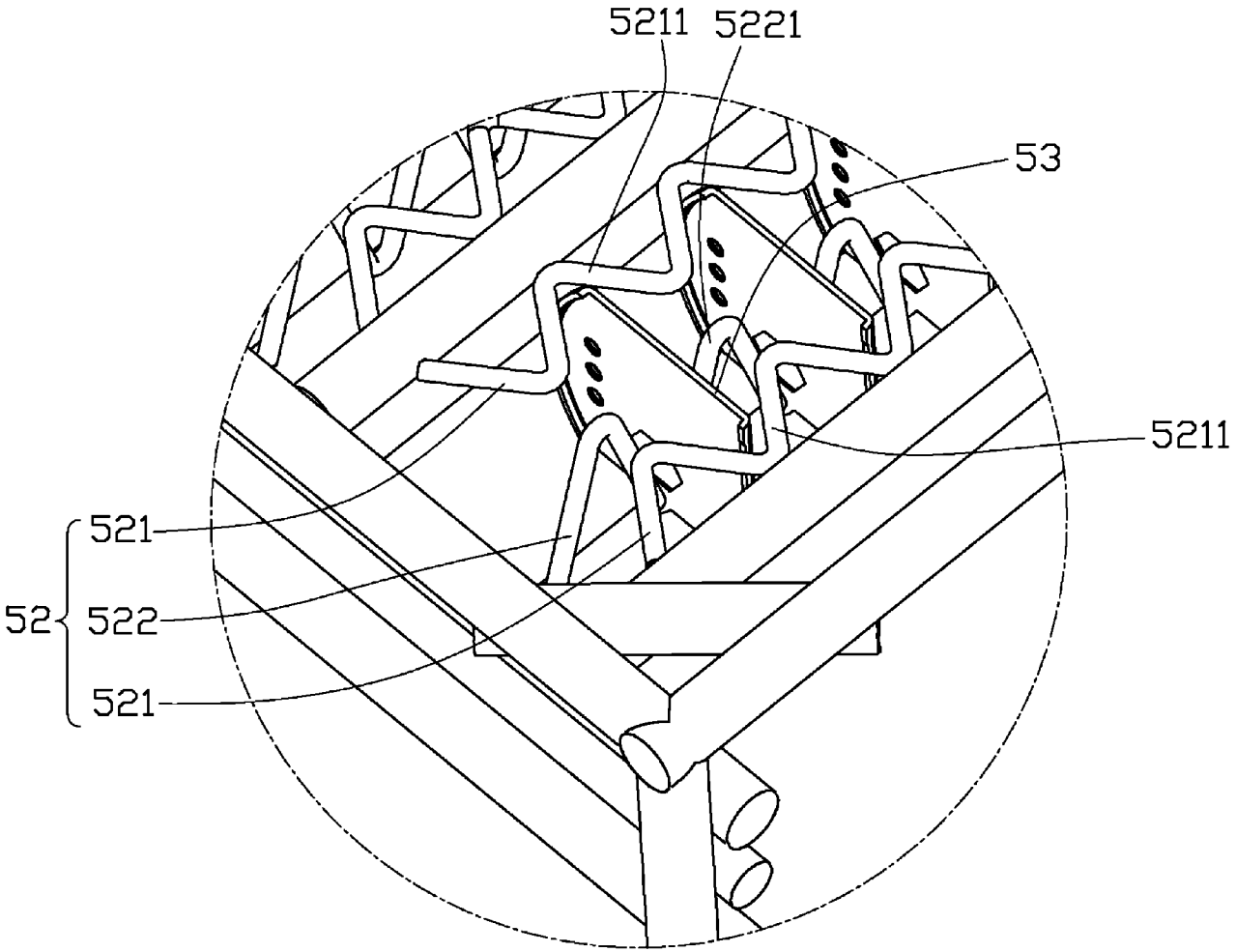
FIG. 6 (RELATED ART)
FIG. 6 is an enlarged view of the portion II shown in FIG. 5.

Also referring to FIG. 4, the rack 100 is used for holding a plurality of workpieces 30 (only one shown in FIG. 4). The workpieces 30 may be housings for a portable electronic device. Each of the workpieces 30 includes a view hole 32 and a plurality of key holes 34 defined therein. During use of the rack 100, the bolt 1486 is removed from the first latching nut 1484, the fixture 20 adjacent to the second stopper 148 is rotated to lean against the second stopper 149. The workpieces 30 are then fitted onto the fixtures 20. Each of the hanging hooks 25 is inserted into the view hole 32, with one of the hanging posts 26 being inserted into one of the key holes 34, thereby the workpieces 30 being fitted on the fixtures 20. The other fixtures 20 are then rotated to lean against its neighboring one of the fixtures 20 in a predetermined order, while the workpieces 30 are fitted onto the fixtures 20 by above-mentioned means. After all the workpieces 30 being fitted on the fixtures 20, the fixtures 20 are rotated to their assembling positions and then the bolt 1486 is secured into the first latching nut 1484 in such manner that the fixtures 20 are fitted between the first stopper 147 and the second stopper 148.

Both two opposite sides of each of the workpieces 30 do not come into contact with the fixtures 20 when the workpieces 30 being fitted onto the fixtures 20. In this way, both the two opposite sides of the workpieces 30 can be prevented from being scratched by the fixtures 20 and thus the quality of the workpieces 30 is maintained.

It should be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rack configured for holding workpieces, the rack comprising:

a base comprising:

two lateral frames, each of the lateral frames including a first stopper and a second stopper mounted thereon; and a fixing frame fitted between the two lateral frames, the fixing frame having two fixing poles parallel to the two lateral frames, each of the two fixing poles having a plurality of latching means mounted thereon in line; and a plurality of fixtures rotatably engaging with the latching means of the fixing frame and being fitted between the first stopper and the second stopper; each of the fixtures including a plurality of hanging hooks and a plurality of hanging posts, each of the hanging hooks associating with a corresponding hanging post to hold a workpiece; each of the fixtures including a basal frame and two latching pins mounted on the basal frame; the basal frame including a first holding beam, a second holding beam, and two parallel supporting poles joined together; the latching pins being respectively fitted to free ends of the supporting poles extending out from the basal frame and being rotatably inserted into the latching means of the fixing frame; the hanging hooks being mounted on the first holding beam and the hanging posts being mounted on the second holding beam.

2. The rack as claimed in claim 1, wherein the base further includes a bottom frame, the bottom frame including four basal bars joined together and a plurality of crisscrossed first supporting branches connected to the basal bars, the two lateral frames respectively being mounted at two opposite side of the bottom frame.

3. The rack as claimed in claim 1, wherein each of the lateral frames further includes two parallel standing poles and a crossbeam fixing on the two standing poles, the first stopper and the second stopper being respectively mounted on the two standing poles.

4. The rack as claimed in claim 3, wherein each of the two standing poles is perpendicularly fitted to the bottom frame, the crossbeam being fitted to the two standing poles at an opposite end to the bottom frame.

5. The rack as claimed in claim 4, wherein each of the lateral frames further includes a plurality of second supporting branches joining with the crossbeam and the bottom frame, the second supporting braches being configured for supporting the crossbeam.

6. The rack as claimed in claim 3, wherein the first stopper includes a first joining branch and a protruding post fixed to the first joining branch, the first joining branch being fitted to one of the standing poles, one end of the protruding post being fixed to the first joining branch, the other end of the protruding post facing to an opposite one of the two lateral frames.

7. The rack as claimed in claim 3, wherein the second stopper includes a second joining branch, a first latching nut, and a bolt, the second joining branch being fitted to one of the standing poles, the first latching nut being fixed to the second joining branch, the bolt being secured in the first latching nut, with one end of the free end bolt extending through the latching nut and facing towards the other lateral frame.

8. The rack as claimed in claim 3, wherein each of the lateral frames further includes a third stopper, with one end thereof being fitted to one of the standing poles and the other end thereof facing to an opposite one of the two lateral frames.

9. The rack as claimed in claim 1, wherein the fixing frame further includes two parallel bearing poles respectively joined together with the fixing poles and fitted between the two lateral frames.

10. The rack as claimed in claim 1, wherein each of the fixtures further includes two spacing bars and two spacing posts respectively fitted on the two supporting poles at an opposite side to the two spacing bars, each of the two spacing bars having two bent ends respectively welded to the two supporting poles.

11. A rack configured for holding workpieces, the rack comprising:

a base comprising:

two lateral frames, each of the lateral frames including two standing poles, a first stopper and a second stopper; the second stopper including a second joining branch, a first latching nut, and a bolt, the second joining branch being fitted to one of the standing poles, the first latching nut being fixed to the second joining branch, the bolt being securable in the first latching nut, with one end of the free end bolt extending through the latching nut and facing towards the other lateral frame; and a fixing frame fitted between the two lateral frames, the fixing frame having two fixing poles parallel to the two lateral frames, each of the two fixing poles having a plurality of latching means mounted thereon in line; and a plurality of fixtures rotatably engaging with the latching means of the fixing frame and being fitted between the first stopper and the second stopper.

* * * * *